US008434532B2

(12) United States Patent
Neglay et al.

(10) Patent No.: US 8,434,532 B2
(45) Date of Patent: May 7, 2013

(54) TWO KNEE LOG CARRIAGE FOR OPTIMUM SCANNING

(75) Inventors: Stanford Neglay, Albany, OR (US); Donald Neglay, Albany, OR (US); Michael Warren, Lebanon, OR (US); Jeffery Warren, Sweet Home, OR (US); John Detroit, Bonanza, OR (US); Robert Presley, Albany, OR (US)

(73) Assignee: Maxi Mill, Inc., Albany, OR (US)

( * ) Notice: Subject to any disclaimer, the term of this patent is extended or adjusted under 35 U.S.C. 154(b) by 586 days.

(21) Appl. No.: 11/833,885

(22) Filed: Aug. 3, 2007

(65) Prior Publication Data

US 2008/0072726 A1 Mar. 27, 2008

Related U.S. Application Data

(60) Provisional application No. 60/821,379, filed on Aug. 3, 2006.

(51) Int. Cl.
*B27C 9/00* (2006.01)

(52) U.S. Cl.
USPC ..... 144/378; 414/14; 144/178

(58) Field of Classification Search ..... 144/209.1, 144/210–215, 215.2, 215.3, 215.4, 1.1, 2.1, 144/3.1, 376, 360, 377–379, 162.1, 178, 144/359; 83/466; 414/14
See application file for complete search history.

(56) References Cited

U.S. PATENT DOCUMENTS

| | | | | |
|---|---|---|---|---|
| 3,797,349 | A * | 3/1974 | Smith | 83/404.1 |
| 3,885,487 | A * | 5/1975 | Weston, Jr. | 83/728 |
| 4,094,220 | A * | 6/1978 | Pryor et al. | 83/712 |
| 4,941,382 | A * | 7/1990 | Smith et al. | 83/713 |
| 5,243,888 | A * | 9/1993 | Bowlin | 83/76.8 |

* cited by examiner

*Primary Examiner* — Dana Ross
*Assistant Examiner* — Matthew G Katcoff
(74) *Attorney, Agent, or Firm* — patenttm.us

(57) ABSTRACT

A log carriage employs a fixed knee and a second, movable knee adapted to move along at least a portion of the length of a log, to enable optimal positioning and minimizing knee interference with scanning of the log.

22 Claims, 3 Drawing Sheets

FIG. 2, TOP VIEW (WITHOUT LOG)

TWO KNEE LOG CARRIAGE FOR OPTIMUM SCANNING

BACKGROUND OF THE INVENTION

This invention relates to sawmill operation. In such operations, raw logs (which might be rather large and heavy) are placed on a moving carriage, which moves the log back and forth in a straight line through the saw for the purpose of sawing off successive slices from the log. Typically the carriage travels along rails.

Conventional carriages employ 3 or 4 "knee" assemblies on the carriage, the knees being in spaced apart positions along the length of the carriage and against which the back side of the log (relative to the saw blade) rest. These knee assemblies also include devices to grip and hold the log in position. So, it may be understood that the knees operate as the back rests and grips to secure the log in position to the carriage. The multiple knees spaced along the carriage enable the carriage to grip and process logs of different lengths. As portions of the logs are sawed off, the knees move the log so that at the next pass of the carriage past the log will again be positioned to saw off yet another board. This back and forth motion of the carriage relative to the saw and the incremental moving of the log face into the plane of the saw blade will continue until the log is completely processed, whereupon the carriage will be loaded with the next log and scanning and sawing of that next log will proceed.

A typical operation is that the log is placed on the carriage and rotated to an optimal position for beginning cutting based on a pre-scan of the log to determine its shape. Further scanning is typically made while the log is on the carriage to further employ in software determining how best to cut the log. With such conventional carriages, each knee obscures a portion of the log from the scanner, so interpolation or smoothing is done to "remove" the knee from the scan and fill in what is presumed to be the configuration of the log in the obscured portion. Such smoothing can result in inaccurate information, if the portion of the log hidden by the knees does not conform to the assumptions of the smoothing algorithms.

SUMMARY OF THE INVENTION

In accordance with the invention, an improved two knee carriage is provided with one knee position being adjustable along the length of a log. The carriage employs a fixed and a movable knee, whereby the movable knee can be positioned to an optimal position along the log (that position is typically determined from the pre-scan data).

Accordingly, it is an object of the present invention to provide an improved carriage adapted for optimum scanning of logs.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 2 is a top view thereof without the log; and.

DETAILED DESCRIPTION

The system according to a preferred embodiment of the present invention comprises a saw carriage having a fixed and movable knee.

Figure 1:
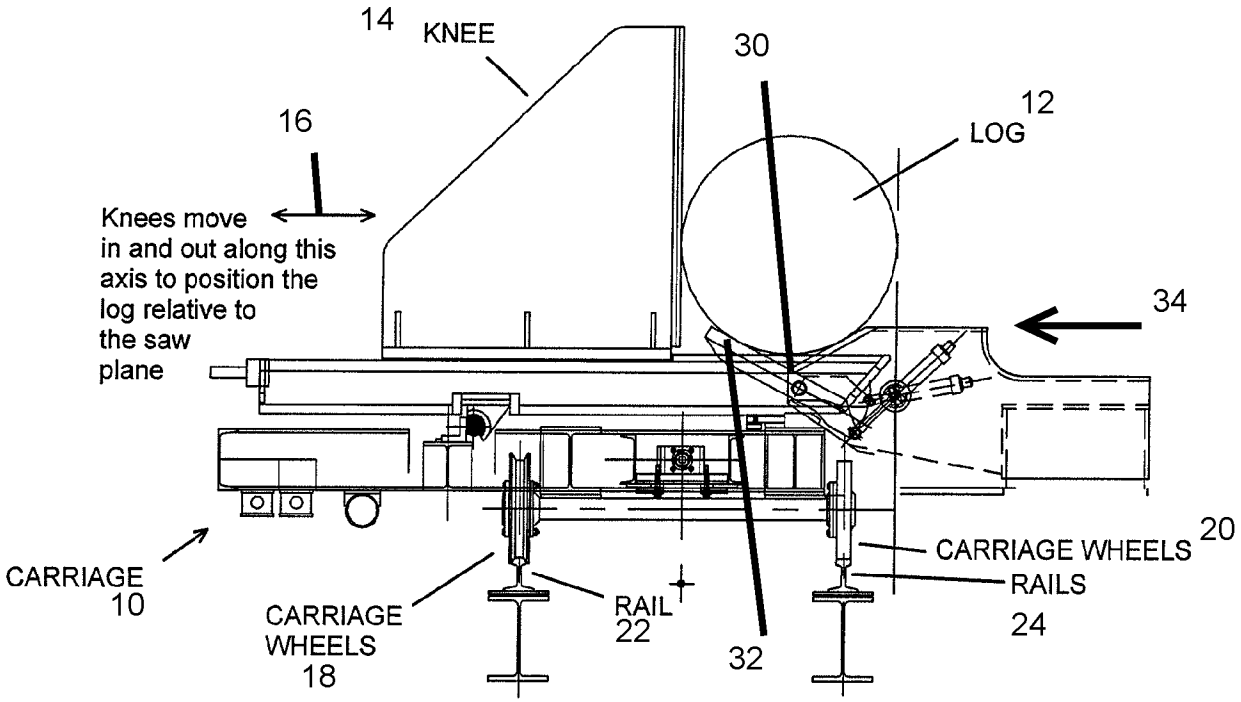
FIG. 1 is an end view of the carriage with a log thereon.

Referring to FIG. 1, an end view of a carriage 10 with a log 12 thereon. A movable knee 14 is translatable in the directions of arrow 16, moving in and out to position the log relative to the plane of the saw that cuts the log. The carriage is provided with front wheels 18 that ride on rail 22 and rear wheels 20 that ride on rails 24 whereby the carriage moves the log through the saw blade for sawing operations thereon by translation of the carriage along the rails by operation of the wheels riding on the rails. In the illustrated embodiment four sets of front and rear wheels 18, 20 are provided.

Figure 2:
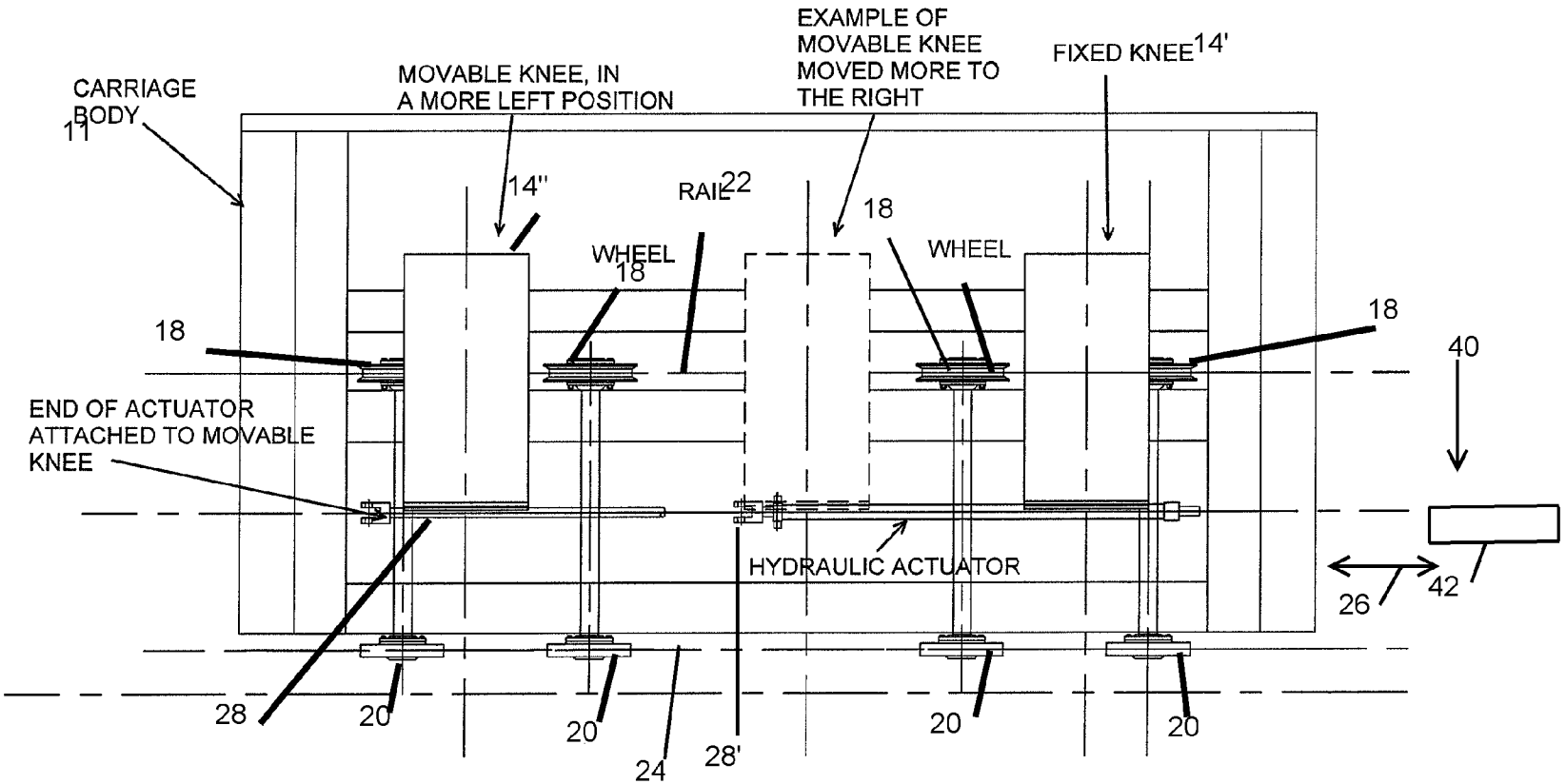

FIG. 2 is a top view of the carriage 10 with the log removed, wherein the carriage comprises a carriage body 11 having a fixed knee 14' near one end of the carriage body (the right most end in this view) and a movable knee 14" which is translatable in the directions of arrow 26 to move the knee 14" left and right in the view of FIG. 2, to position the knee differently for accommodation of different configurations of logs 12.

The translation mechanism to move the knee 14" comprises an actuator 28, which is a hydraulic actuator in a particular embodiment, which attaches to the movable knee 14" and extension and retraction of the actuator causes the knee to translate along the carriage body in the directions of arrow 26. In FIG. 2, a view in phantom is show of the movable knee 14" in a more rightward position, to illustrate an example of a different position thereof, with the actuator 28' showing a more retracted position of the actuator, while actuator 28 shows a more extended position . . . ; and.

Figure 3:
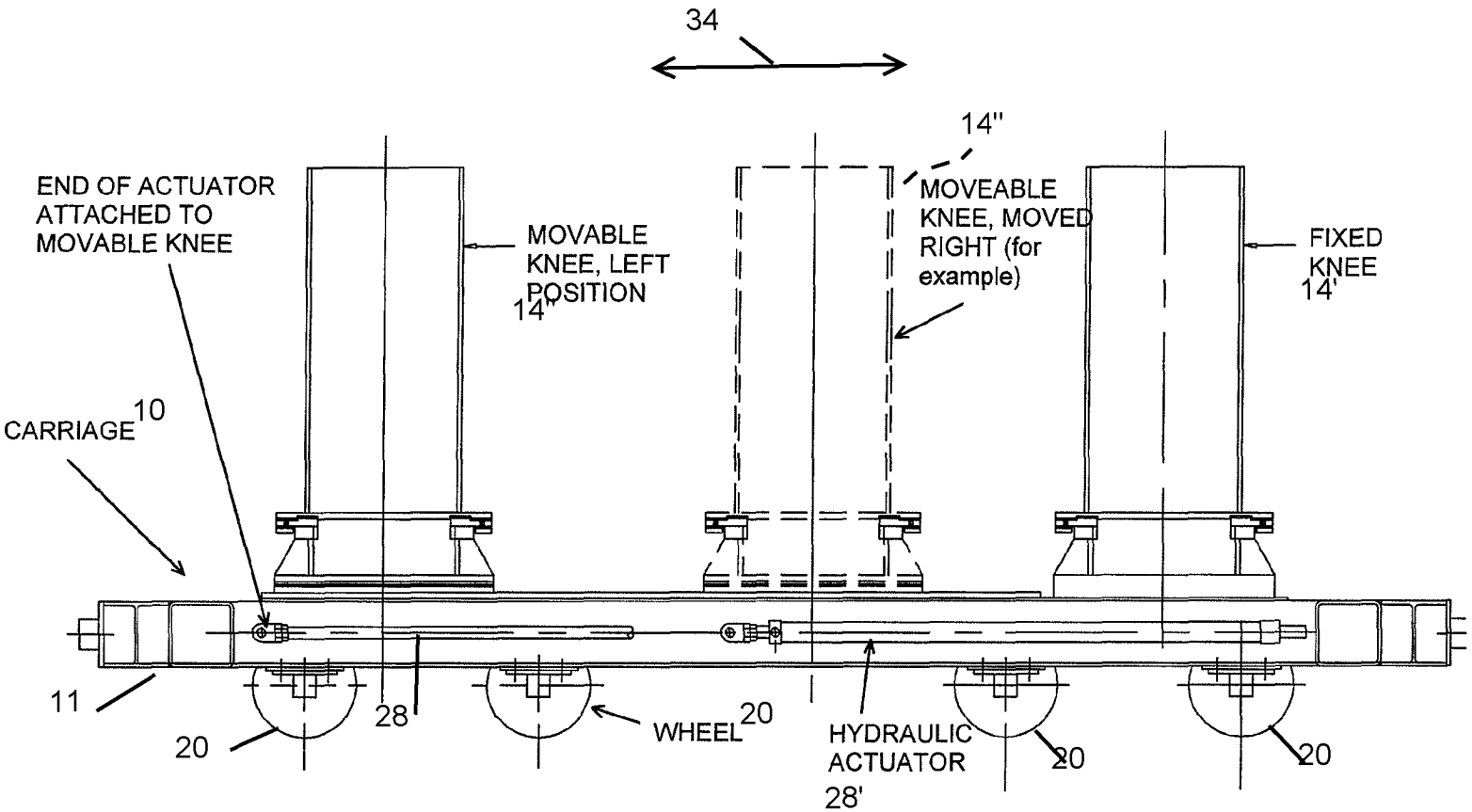
FIG. 3 is a side view thereof.

FIG. 3 is a side view of the carriage with log removed, from the front thereof, for further illustration of the system.

Typical operation is that the moveable knee 14" is positioned to a desired location along the length of the carriage, based on the dimensions of next log that is to be loaded (this information is known from a pre-scan of the log, which might typically be done as the log is being conveyed to the carriage). The log is then loaded onto the carriage by a conveying apparatus 30, which in the illustration comprises a cradle that moves the log onto the carriage in the direction of arrow 34 and then pulls away after the log is received by the carriage. This may be accomplished by, for example, front portion 32 of the cradle being moved down or away from the log to enable the cradle to be retracted in the opposite direction of arrow 34, and/or by the cradle moving downwardly below the bottom plane of the log to enable retraction. The log may be rotated by the carriage system or other means to be in the optimal rotational position for performing the first cut of the log, the log is clamped to the knees by means not shown, and the carriage then moves the log through the saw, back and forth in the directions of arrow 34, along the rails 22, 24, typically multiple times, the knees translating the log as each saw pass is made, for example in the direction of arrow 40 of FIG. 2, to have the log in position to engage the saw 42 (illustrated schematically) with next pass of the log by the saw.

By using such a system, advantages include:

the scanner is able to obtain more data from the scan of the log, to more accurately process the log, since the third or fourth knees are not blocking the view of the scanner, or more easily process the log since less interpolation or smoothing is required.

since the carriage has fewer knees, the weight of the carriage may be reduced by approximately 2 tons, for a typical installation, so less energy is expended in moving the carriage, saving operation costs.

also, since in the view of FIG. 3, the saw is to the right of the view, and the length of the log has been determined to move the left knee to the left end of the log, the carriage need not move through its entire range of left to right motion in the case of logs that are shorter, reducing overall carriage movement and increasing production throughput. Conventional systems, for example, might have the carriage travel its entire rightward motion path before shifting to move leftward.

Accordingly, an improved carriage is provided that is adapted for optimal scanning to provide more accurate log analysis, lower operation cost and higher throughput.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A log carriage, comprising a first, knee mounted in relation to the carriage; and a second, movable knee, mounted in movable relation relative to the carriage, adapted for translational movement of the second knee along a portion of a length of the carriage on a cutting translation axis of the carriage to alter a distance between said first and second knee for optimal positioning along a length direction of a log to be put onto the carriage.

2. The log carriage according to claim 1, further comprising an actuator in relation to said movable knee, for effecting said translational movement of said movable knee.

3. The log carriage according to claim 2, wherein said actuator comprises a hydraulic actuator.

4. The log carriage according to claim 1, wherein said first and second knees comprise portions to engage the log and said first and second knees are translatable relative to a saw plane for adjustable positioning of the log relative to the saw plane.

5. The log carriage according to claim 1, wherein said log carriage comprises translation mechanism for effecting movement of the carriage into and away from a saw effecting a sawing operation on the log.

6. The log carriage according to claim 5, wherein said translation mechanism comprises wheels.

7. The log carriage according to claim 6, further comprising a rail system on which said wheels ride to accomplish translation.

8. The log carriage according to claim 1, wherein said carriage is in absence of any additional knees beyond said first and said second knees.

9. A log carriage system, comprising:

a carriage adapted for translational movement relative to a saw;

a fixed knee mounted in relation to the carriage;

a movable knee, mounted in movable relation relative to the carriage, adapted for translational movement of the movable knee along a portion of a length of the carriage for altering a distance between said fixed knee and said movable knee for positioning relative to a log to be put onto the carriage, said movement being along a length direction of the log; and an actuator in relation to said movable knee, for effecting said translational movement of said movable knee along said portion of said length of the carriage.

10. The log carriage system according to claim 9, wherein said fixed knee and said movable knee comprise portions to engage the log and said first and second knees are translatable in a direction substantially normal relative to a saw plane for adjustable saw depth positioning of the log relative to the saw plane.

11. The log carriage system according to claim 9, wherein said log carriage is adapted for translational movement by a translation mechanism for effecting movement of the carriage into and away from a saw effecting a sawing operation on the log.

12. The log carriage system according to claim 11, wherein said translation mechanism comprises wheels.

13. The log carriage system according to claim 12, further comprising a rail system on which said wheels ride to accomplish translation.

14. The log carriage system according to claim 9, wherein said actuator comprises a hydraulic actuator.

15. A method of operating a log carriage for accomplishing sawing operations on a log, comprising:

providing a fixed knee;

providing a movable knee adapted for moving closer to or farther away from said fixed knee along a length direction of the log;

moving said movable knee to a position based on dimensions of a log to be placed on the carriage; and receiving the log on the carriage.

16. The method according to claim 15, further comprising moving the carriage relative to a saw to accomplish sawing of the log.

17. The method according to claim 16, further comprising, after sawing the log, repositioning the log and moving the carriage again to accomplish additional sawing of the log.

18. The method according to claim 17, wherein said repositioning comprises moving the log substantially normal to a saw cutting plane.

19. The method according to claim 18, wherein said moving is accomplished by moving said fixed knee and said movable knee in direction substantially normal to the saw cutting plane.

20. The log carriage according to claim 1, wherein said first knee is fixed against movement along said carriage relative to a longitudinal axis of a log.

21. The log carriage according to claim 1 wherein said second, movable knee moves in a translation direction and said distance between said first and second knee altered by said movement is a distance in said translation direction.

22. A log carriage, consisting of:

two knees, a first of said knees mounted in fixed relation to the carriage; and a second of said knees being a movable knee, mounted in movable relation relative to the carriage, adapted for translational movement of the second knee along a portion of a length of the carriage to alter a distance between said first and second knee for optimal positioning along a length direction of a log to be put onto the carriage.

* * * * *